US008127525B2

(12) United States Patent
Bart et al.

(10) Patent No.: US 8,127,525 B2
(45) Date of Patent: Mar. 6, 2012

(54) SYSTEM FOR DISSIPATING ENERGY IN THE EVENT OF A TURBINE SHAFT BREAKING IN A GAS TURBINE ENGINE

(75) Inventors: Jacques Rene Bart, Soisy sur Seine (FR); Didier Rene Andre Escure, Nandy (FR); Claude Marcel Mons, Savigny le Temple (FR); Stephane Rousselin, Hericy (FR)

(73) Assignee: SNECMA, Paris (FR)

( * ) Notice: Subject to any disclaimer, the term of this patent is extended or adjusted under 35 U.S.C. 154(b) by 901 days.

(21) Appl. No.: 12/126,407

(22) Filed: May 23, 2008

(65) Prior Publication Data

US 2008/0289315 A1 Nov. 27, 2008

(30) Foreign Application Priority Data

May 25, 2007 (FR) ..... 07 03759

(51) Int. Cl.
*F02G 3/00* (2006.01)

(52) U.S. Cl. ..... 60/39.091; 415/9

(58) Field of Classification Search ..... 60/779, 60/39.091; 415/9; 416/2
See application file for complete search history.

(56) References Cited

U.S. PATENT DOCUMENTS 2,966,333 A * 12/1960 Flanagan ..... 416/2
3,075,741 A 1/1963 Laubin
4,498,291 A * 2/1985 Jeffery ..... 60/39.091
4,505,104 A 3/1985 Simmons
5,029,439 A * 7/1991 Berneuil et al. ..... 60/39.091
2006/0042226 A1 3/2006 Trumper et al.
2006/0251506 A1 * 11/2006 Soupizon ..... 415/9

FOREIGN PATENT DOCUMENTS

EP 0 374 003 A1 6/1990
EP 1 640 564 A1 3/2006

OTHER PUBLICATIONS

U.S. Appl. No. 12/126,648, filed May 23, 2008, Bart, et al.

* cited by examiner

*Primary Examiner* — Louis Casaregola
*Assistant Examiner* — Andrew Nguyen
(74) *Attorney, Agent, or Firm* — Oblon, Spivak, McClelland, Maier & Neustadt, L.L.P.

(57) ABSTRACT

A device for, in a gas turbine engine, braking a turbine including a rotor, having at least one disk with a rim driving a shaft and capable of rotating with respect to a stator, is disclosed. The device is for the event of the shaft breaking and includes a first braking member, secured to the rim and provided with at least one cutting element, and a second braking member secured to the stator downstream of the rim and including a ring-shaped element made of a material that can be cut by the cutting element. The two braking members coming into contact with one another through axial displacement of the rotor once the shaft has broken. The cutting element of the first braking member cuts the ring-shaped element of the second braking member.

8 Claims, 1 Drawing Sheet

SYSTEM FOR DISSIPATING ENERGY IN THE EVENT OF A TURBINE SHAFT BREAKING IN A GAS TURBINE ENGINE

BACKGROUND OF THE INVENTION

The present invention relates to the field of gas turbine engines and, in particular, that of multiple flow turbojet engines and relates to a system that, in the event that a shaft of the machine breaks, allows the machine to be stopped in the shortest possible time.

In a multiple flow turbofan jet engine, the fan is driven by the low-pressure turbine. When the shaft connecting the fan rotor to the turbine rotor breaks, the resistive torque on the turbine is suddenly removed although the flow of driving gas continues to transmit its energy to the rotor. This results in a rapid increase in the rotational speed of the rotor which is liable to reach the limit that it can withstand and shatter, with the ensuing catastrophic consequences that this has.

DESCRIPTION OF THE PRIOR ART

It has been proposed that the supply of fuel to the combustion chamber be interrupted in order to eliminate the source of energy via which the rotor is accelerated. One solution is to monitor the rotational speed of the shafts using redundant measurement means and to command an interruption in the supply of fuel when overspeed is detected. According to U.S. Pat. No. 6,494,046, the rotational frequencies are measured at the two ends of the shaft at the bearings and these are continuously compared in real time.

Means for braking the rotor when such an incident occurs have also been proposed. The axial displacement of the rotor following breakage of the shaft triggers the actuation of mechanisms aimed at dissipating the kinetic energy of this. These are, for example, fixed fins of the adjacent guide vane assembly which are tilted toward the rotor blades in order to position themselves between these blades and cross their paths. The kinetic energy is dissipated by the rubbing of the parts against one another, their deformation, or even their breakage. A solution of this type is described in patent application EP 1640564 in the name of the present applicant. In this solution, destruction means are mounted on a fixed impeller adjacent to an impeller of the turbine that is to be braked, and are designed to shear the legs from the rotor blades upstream as the rotor begins to move in the downstream direction.

This solution, although effective, leads to significant repair costs because of the damage caused to the blading.

SUMMARY OF THE INVENTION

The present invention is oriented toward a simple, effective and inexpensive solution for reducing the rotational speed, in a gas turbine engine, of a turbine comprising a rotor driving a shaft and capable of rotating inside a stator in the event of said shaft breaking.

According to the invention, the device for, in a gas turbine engine, braking a turbine comprising a rotor, having at least one disk with a rim, driving a shaft and capable of rotating with respect to a stator, is a device which comprises a first braking member, secured to said rim and provided with at least one cutting element, and a second braking member secured to the stator downstream of the rim, comprising a ring-shaped element made of a material that can be cut by the cutting element of the first braking member, the two braking members coming into contact with one another through axial displacement of the rotor once the shaft has broken, the cutting element of the first braking member cutting the ring-shaped element of the second braking member.

The solution of the invention therefore consists in dissipating the energy of the rotor between two members which are designed specifically to afford braking. These means allow an increase in the contact area in accordance with the desired objective and provide a high coefficient of friction.

The advantage is also that the maximum speed that the rotor has to withstand without shattering can be reduced. This speed is the speed liable to be reached when the shaft breaks.

By positioning the braking members outside of the fan flow duct, the blades are spared and the region in which this dissipation of energy takes place can be localized.

For an engine comprising an exhaust casing, the first member is advantageously secured to the last turbine stage of the rotor and the second member is advantageously secured to the exhaust casing.

According to one embodiment, the first braking member comprises a plurality of cutting elements distributed about the axis of the engine, and the elements are produced by a machining operation with the rim. The cutting elements are in the form of cutters designed to cut into the ring-shaped element, removing material.

According to another feature, the ring-shaped element is added on to a flange mounted on the stator.

The invention also relates to a twin spool gas turbine engine with a low-pressure turbine section in which said section is equipped with a braking device such as this.

BRIEF DESCRIPTION OF THE DRAWINGS

Other features and advantages will emerge from the description of a nonlimiting embodiment of the invention with reference to the drawings in which.

DESCRIPTION OF THE PREFERRED EMBODIMENT

Figure 1:
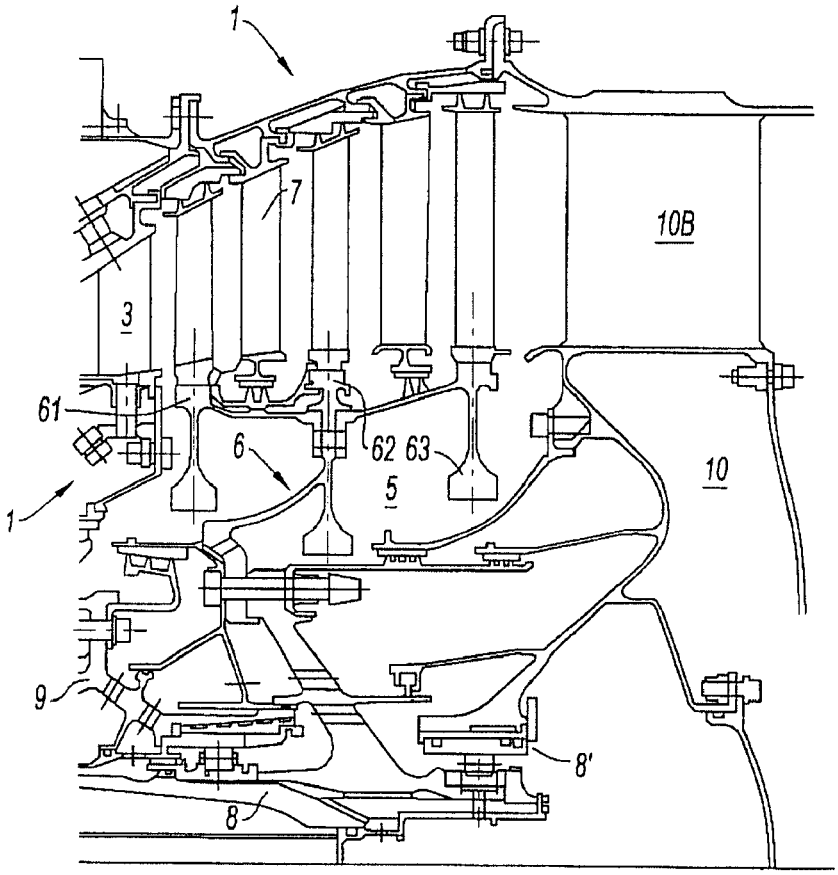
FIG. 1 shows an axial half section of the turbine section of a twin spool gas turbine engine.

FIG. 1 shows part of the turbine section 1 of a gas turbine engine. In a twin spool bypass engine, the turbine section 1 comprises an upstream high-pressure turbine, not visible in the figure, which receives the hot gases from the combustion chamber. The gases, having passed through the blading of the high-pressure turbine impeller, are directed through a set of fixed guide vanes 3, on to the low-pressure turbine section 5. This section 5 is made of a rotor 6 here in the form of a drum from an assembly of several bladed disks 61, 62, 63, in this example three bladed disks. The blades, which comprise a vane and a root, are mounted, generally individually, at the periphery of the disks in housings made in the rim. Sets of fixed guide vanes 7 are interposed between the turbine stages, each having the purpose of suitably directing the gas stream with respect to the moving blade downstream. This assembly forms the low-pressure turbine section 5. The rotor 6 of the low-pressure turbine is mounted on a shaft 8 concentric with the high-pressure shaft 9, which is extended axially toward the front of the engine where it is secured to the fan rotor. The rotor assembly is supported by appropriate bearings situated in the front and rear parts of the engine. FIG. 1 shows the shaft 8 supported by a bearing 8' in the structural casing, known as the exhaust casing 10. The exhaust casing is provided with means of attachment for mounting it to an aircraft.

When the shaft 8 accidentally breaks, the moving assembly of the low-pressure turbine shifts rearward, to the right in the figure, because of the pressure exerted by the gases. Furthermore, its rotation is accelerated because its resistive torque has disappeared and also because of the tangential thrust that the hot gases continue to exert on the moving blading as these gases pass through the turbine.

In order, according to the invention, to prevent the turbine from running away and to prevent its speed from reaching the maximum speed allowed before it shatters, a braking device is incorporated into the turbine section.

Figure 2:
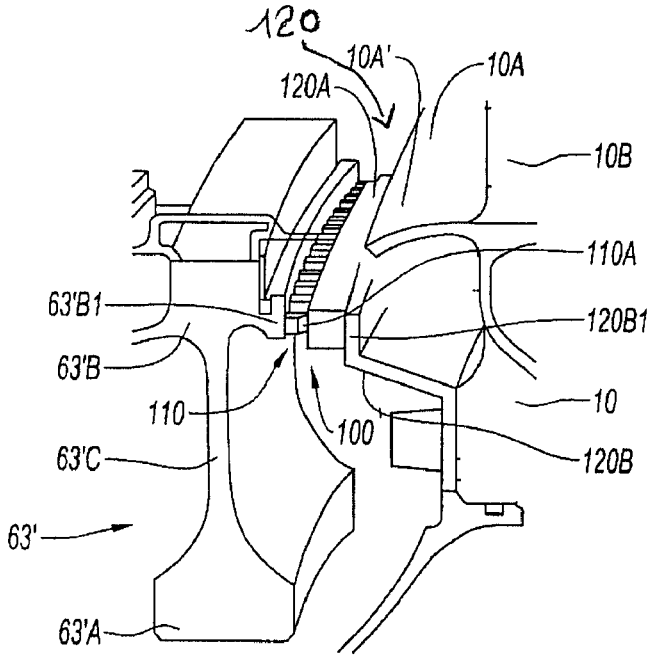
FIG. 2 shows a braking device formed on the low-pressure turbine section of the gas turbine engine.

This device 100 is depicted in FIG. 2 which is a partial perspective view of the turbine disk 63' and of the exhaust casing.

The disk 63' corresponds to the disk 63 in FIG. 1 modified according to the invention. The disk 63' has a conventional or some other form, in this example with a hub 63'A, a rim 63'B at its periphery and a thin radial web part 63'C between the hub and the rim. The rim 63'B is provided with means of attachment of the blades which extend in the radial direction into the annular passage through which the driving gases travel. The blades and their means of attachment do not form part of the invention and have not been depicted in their entirety in the figure, merely an outline in the plane of section being visible. The exhaust casing 10 is depicted in its part that faces the disk 63'. It comprises an annular platform 10A that forms the interior wall of the gas passage in the continuation of the platforms of the periphery of the disk 63' of the last turbine stage. Stator vanes 10B extend radially into the annular passage. The platform 10A extends axially upstream toward the disk 63' in the form of an annular sealing tongue 10A'.

The braking device 100 of the invention is described hereinafter. It comprises a first braking member 110 which consists of cutting elements 110A. The first braking member 110 is secured to the rim 63'B. More specifically in this example, the member 110 is secured to a radial flange part 63'B1 downstream at the rim. According to the example depicted, the elements 110A are teeth inclined in the direction in which the disk rotates. Their distal end is beveled and shaped to form a cutting means, such as a shear. The cutting edge in this instance is radial or, alternatively, substantially radial.

This first braking member (110) may be added on to the flange part 63'B1 of the rim 63'B but may also be obtained by a machining operation from a casting at the same time as the rim. In this case, it is made of the same metal as the rim and has the hardness of the rim.

The second braking member 120 is mounted on the stator formed by the exhaust casing 10. It comprises an annular flange 120B bolted on to an annular rib of the casing 10 under the tongue 10A'. The flange 120B comprises a radial flange part 120B1 positioned downstream of the first braking member 110. A ring-shaped element 120A is secured to the flange part 120B1. This ring-shaped element 120A is of rectangular cross section with a radial face perpendicular to the axis of rotation, held a short distance downstream of the cutting edges of the cutting elements (110A) that form the first cutting member (110).

The material of which the ring-shaped element 120A is made is of a lower hardness than that of the cutting elements 110A. It may be made as one piece with the flange 120B but may equally well have been added on to the flange part.

In normal operation, the turbine disk rotates about its axis and the cutting elements 110A travel in rotation about the engine axis, parallel to the front face of the ring-shaped element 120A preferably without touching it.

The combination of the elements 110A and 120A needs, when the disk shifts axially downstream because the shaft 8 has broken, to allow the cutting elements 110A to rub against the ring-shaped element 120A. The rotation associated with the pressure causes the element 120A to be cut by the cutting elements 110A in the manner of a conventional cutting tool. The energy is supplied by the rotating rotor and is thus dissipated.

The geometry of the cutting elements 110A; bevel angle, length of cutting edge, and the material of which they are made are determined together and in conjunction with the material of the annular element 120A.

The invention claimed is:

1. A device for, in a gas turbine engine, braking a turbine comprising a rotor, having at least one disk with a rim, driving a shaft and capable of rotating with respect to a stator including a stator vane provided on an annular platform of an exhaust casing, this device being for the event of said shaft breaking and comprising:

a first braking member, secured to a downstream radial flange of said rim and provided with at least one cutting element comprising teeth extending towards a downstream direction and inclined in a rotating direction of the disk with respect to an axis of rotation of the disk; and a second braking member secured to the stator downstream of the rim, comprising a ring-shaped element made of a material that can be cut by the cutting element, the ring-shaped element extending towards an upstream direction with an upstream radial face perpendicular to the axis of rotation and a downstream face secured to a radial flange part of a radial flange provided on the exhaust casing, the radial flange being disposed radially below the annular platform, wherein the two braking members come into contact with one another through axial displacement of the rotor once the shaft has broken such that the cutting element of the first braking member cuts the ring-shaped element of the second braking member.

2. The device as claimed in claim 1, wherein the first braking member is secured to the last turbine stage of the rotor.

3. The device as claimed in claim 1 or 2, wherein the first braking member comprises a plurality of cutting elements distributed about the axis of the engine.

4. The device as claimed in claim 1, wherein the at least one cutting element of the first braking member is produced by a machining operation with the rim.

5. The device as claimed in claim 1, wherein the at least one cutting element of the first braking member is produced by a machining operation on an additional element attached to the rim.

6. The device as claimed in claim 4 or 5, wherein the at least one cutting element is in the form of cutters designed to cut into the ring-shaped element of the second braking member, removing material.

7. A twin spool gas turbine engine with a low-pressure turbine section, wherein said section is equipped with a braking device as claimed in claim 1.

8. The device as claimed in claim 1, wherein distal ends of the teeth are beveled.

* * * * *